US008787812B2

(12) United States Patent
Gomi

(10) Patent No.: US 8,787,812 B2
(45) Date of Patent: Jul. 22, 2014

(54) IMAGE FORMING APPARATUS

(75) Inventor: Fumiteru Gomi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 264 days.

(21) Appl. No.: 13/407,015

(22) Filed: Feb. 28, 2012

(65) Prior Publication Data

US 2012/0230710 A1 Sep. 13, 2012

(30) Foreign Application Priority Data

Mar. 10, 2011 (JP) ..... 2011-053195

(51) Int. Cl.
*G03G 15/02* (2006.01)
*G03G 15/00* (2006.01)

(52) U.S. Cl.
CPC ..... *G03G 15/5037* (2013.01); *G03G 15/0266* (2013.01)
USPC ..... 399/346; 399/49; 399/66; 399/71; 399/99

(58) Field of Classification Search
CPC ..... G03G 15/5033; G03G 15/5037; G03G 15/5041; G03G 15/0266; G03G 15/16
USPC ..... 399/44, 49, 50, 66, 71, 99, 159, 346
See application file for complete search history.

(56) References Cited

U.S. PATENT DOCUMENTS 5,890,038 A 3/1999 Ohsawa et al.
6,052,545 A 4/2000 Komiya et al.
6,064,837 A 5/2000 Hashimoto et al.
6,088,548 A 7/2000 Hashimoto et al.
6,144,824 A 11/2000 Hashimoto et al.
6,215,967 B1 4/2001 Takeda et al.
6,219,509 B1 4/2001 Komiya et al.
6,314,251 B1 11/2001 Gomi et al.
6,393,238 B1 5/2002 Hashimoto et al.
6,477,342 B2 11/2002 Komiya et al.
6,519,422 B1 2/2003 Takeda et al.
7,113,712 B2 9/2006 Gomi
7,395,001 B2 7/2008 Gomi
7,421,218 B2 9/2008 Gomi
7,705,866 B2 4/2010 Gomi et al.
7,881,627 B2 2/2011 Hano et al.
2010/0316401 A1* 12/2010 Gomi ..... 399/49
2011/0058834 A1* 3/2011 Inami et al. ..... 399/50
2011/0255892 A1* 10/2011 Aoki ..... 399/66

FOREIGN PATENT DOCUMENTS

JP 2000-181321 A 6/2000

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus includes a member (drum), a charging device, an exposure device, a developing device, a transfer device, a cleaning blade, a selecting device for selecting an execution mode from an image forming mode and a recovery mode, and a controller for controlling a peak-to-peak voltage applied to the charging device in the operation in the recovery mode. When the recovery mode is selected, the controller effects control so that a band-like toner image is formed on the drum and is supplied to the cleaning blade and so that a peak-to-peak voltage of the AC voltage larger than that of the AC voltage applied to the charging device in the operation in the image forming mode is applied to the charging device in a predetermined period after a leading end of the band-like toner image subjected to removal by the cleaning blade passes through the charging device.

7 Claims, 8 Drawing Sheets

IMAGE FORMING APPARATUS

FIELD OF THE INVENTION AND RELATED ART

The present invention relates to an image forming apparatus, using an electrophotographic type, such as a copying machine, a printer or a facsimile machine.

In image formation by electrophotography represented by that for the copying machine or the printer, first, a surface of a member is uniformly charged by a charging means and then is exposed to light by an exposure means to form an electrostatic latent image. As the charging means, in addition to those of a corona charging type, those of a contact charging type, in which an electroconductive rubber roller or brush is contacted, from viewpoints of ozone reduction, cost, space saving and the like are used. Then, the electrostatic latent image is developed as a toner image by depositing a toner on the electrostatic latent image by a developing means, and then the toner image is transferred from the member onto a transfer-receiving member. A developer left after the transfer is removed and collected by a cleaning means such as a cleaning blade. Then, the surface of the member is subjected to charge removed by a charge-removing means.

As the photosensitive member, an organic photosensitive member has been widely used. In order to improve durability, it is known that the use of a curable resin material in a surface layer is effective. In the case where the curable resin material is used in the surface layer of the member, compared with a thermoplastic resin material or the like, a mechanical strength is increased, so that the surface layer becomes hard to be abraded and hard to be damaged and thus a lifetime thereof is prolonged.

In the case where the curable resin material is used in the surface layer of the photosensitive member, from the viewpoint of durability against damage and abrasion of the surface layer, it is also known that the use of an electron beam as a curing means of the curable resin material is useful. Therefore, an electrophotographic system capable of considerably extending the lifetime of the photosensitive member with respect to the durability against the damage and the abrasion by using the photosensitive member having the surface layer cured by the electron beam can be established.

Further, in addition to the organic photosensitive member and an inorganic photosensitive member, an amorphous silicon member in which a photosensitive layer of amorphous silicon is formed on an electroconductive support is also used.

Substances, such as ozone or nitrates as an electric discharge product, generated by electric discharge caused by primary charging of these photosensitive members form coating films on the photosensitive members, thus generating image flow. This is one of the problems of an electrophotographic apparatus. This is true for a post charger, a transfer charger and a separation charger.

Therefore, such a method that the developer is deposited on the photosensitive member and is supplied to a cleaning device, thereby to enhance an abrasion effect of the photosensitive member surface (hereinafter referred to as a "block band mode") has been taken. As timing of the supply of the developer, there was a need to supply the developer in a state other than that of image formation. Particularly, in the case where the photosensitive member is used in a high-humidity environment, when the member is left standing for a long term after an image forming operation, the ozone product or the electric discharge product is deposited on and takes up moisture on the photosensitive member surface, so that an image in the form of image flow is generated as an initial image after main switch actuation of the image forming apparatus. For that reason, an operation in the black band mode was executed during a main assembly start up time during the main switch actuation or in the case where a certain number of sheets subjected to image formation at the time of an end of the image forming operation was counted.

Further, a method in which a switch for causing a user to execute the operation in the black band mode appropriately in the case where the image flow occurs is displayed on an operating panel and a method in which whether or not the operation in the black band mode is executed is determined depending on a detection result of an environment sensor have been proposed in Japanese Laid-Open Patent Application 2000-181321.

Generally, in order to maintain image uniformity, it is required that the surface of the photosensitive member is uniform. This is because in the case where the surface of the photosensitive member is uneven, partial improper charging or excessive charging is effected to result in visualization as black points or white points on an image.

Here, as described above, to the member surface, members such as a contact charging member, an intermediary transfer member, a contact developer carrying member and the cleaning blade are contacted in a state in which certain pressure is always applied, so that the photosensitive member surface is abraded with rotation of the photosensitive member. When the abrasion progresses in a surface uniform state, local defect is not generated on the image.

However, generally in the electrophotographic image forming apparatus, there is a need to periodically exchange expendable parts such as developing container, the charging member, the photosensitive member and the cleaning blade. Further, in the case where the need of various maintenances arises, a casing cover is opened and then parts are demounted and mounted. At that time, foreign matter introduction cannot be necessarily prevented. For example, when metal powder or the like is introduced and enters a portion where the above-described contact member is contacted to the photosensitive member, damage of the photosensitive member by its pressure can occur. With respect to such an accident, also in the organic photosensitive member using the above-described curable resin material and in the amorphous silicon photosensitive member, there arises a limit of prevention.

SUMMARY OF THE INVENTION

A principal object of the present invention is to provide an image forming apparatus capable of causing a photosensitive member to complete an original lifetime of the photosensitive member to maintain a certain image quality without being exchanged even in the case where the photosensitive member is partly damaged.

According to an aspect of the present invention, there is provided an image forming apparatus comprising: a rotatable photosensitive member; a charging device for electrically charging the photosensitive member by being supplied with a superimposed charging bias of a DC voltage and an AC voltage; an exposure device for exposing to light the photosensitive member, charged by the charging device, to form an electrostatic image; a developing device for developing the electrostatic image with a toner; a transfer device for transferring a toner image from the photosensitive member onto a recording material by being supplied with a transfer bias; a cleaning blade for removing the toner remaining on the photosensitive member; a selecting device for selecting a mode, in which an operation is executed, from modes including at least an image forming mode in which an image corresponding to inputted image information is formed on the recording material and a recovery mode different from the image forming mode; and a controller for effecting, when execution of the operation in the recovery mode is selected by the selecting means, control so that a band-like toner image is formed on the photosensitive member in a certain amount and in a certain area and then is supplied to the cleaning blade by changing the transfer bias applied to the transfer device and so that a peak-to-peak voltage of the AC voltage larger than that of the AC voltage applied to the charging device in the operation in the image forming mode is applied to the charging device in a predetermined period after a leading end of the band-like toner image subjected to removal by the cleaning blade passes through the charging device.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
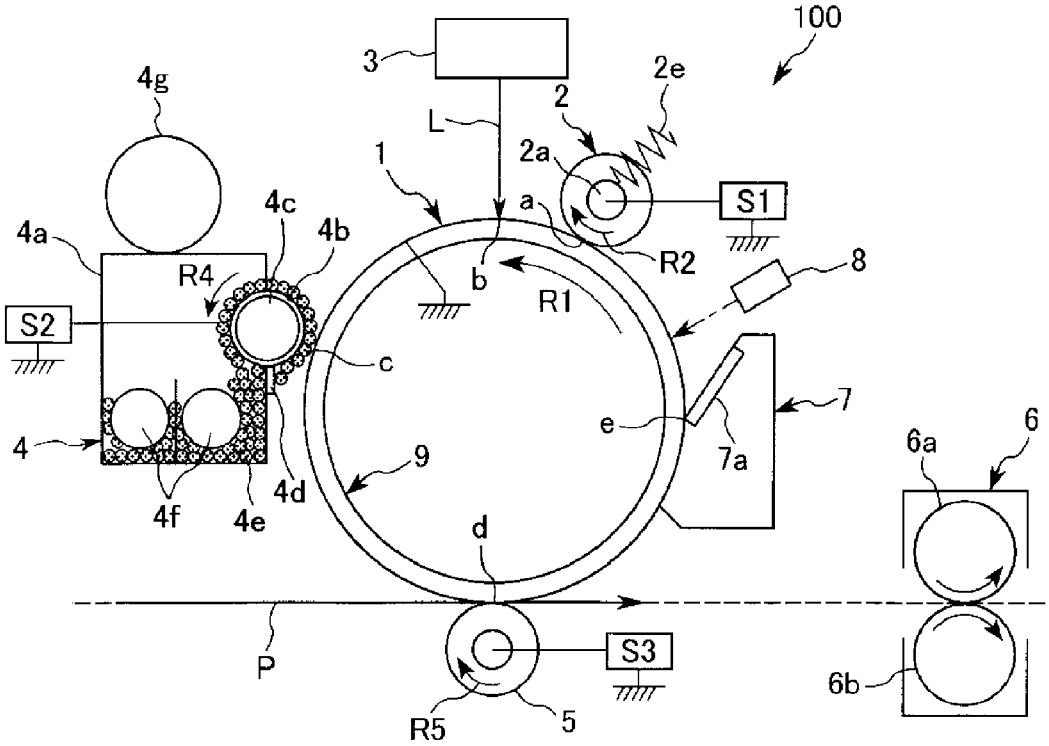
FIG. 1 is a schematic illustration of an embodiment of an image forming apparatus according to the present invention.

Hereinbelow, embodiments of the image forming apparatus according to the present invention will be described with reference to the drawings.

Embodiment 1

The image forming apparatus according to the present invention can be suitably implemented in electrophotographic image forming apparatuses such as a full-color copying machine, a monochromatic copying machine, a monochromatic laser beam printer, a full-color laser beam printer, a laser facsimile machine and other machines.

(General Structure of Image Forming Apparatus)

First, with reference to FIG. 1, a general structure of the image forming apparatus in this embodiment will be described.

In this embodiment, the image forming apparatus is a monochromatic laser beam printer which utilizes a transfer type electrophotographic process, which employs a contact charging method and a reverse development method, and which has an A3 size as a maximum sheet passing size.

The image forming apparatus in this embodiment includes a rotatable photosensitive member type electrophotographic photosensitive member (hereinafter referred to as a "photosensitive drum") 1, as a first image bearing member, which is rotatably carried. Along a rotational direction (counterclockwise direction) R1 of the photosensitive drum 1, around the photosensitive drum 1, the following devices (means) are disposed. That is, the devices include a charging between (a roller charger) 2 as a contact charging member which is a charging means, a developing device (developing means) 4, a transfer roller 5 as a contact transfer member which is a transfer means, and a cleaning device (cleaning means) 7 provided with a cleaning blade 7*a* for removing a residual toner on the photosensitive drum 1. Above a space between the charging roller 2 and the developing device 4, an exposure device 3 is provided. Further, a fixing device 6 is provided at a downstream side of a transfer portion d, formed between the photosensitive drum 1 and the transfer roller 5, with respect to a conveying direction of a transfer material.

Figure 2:
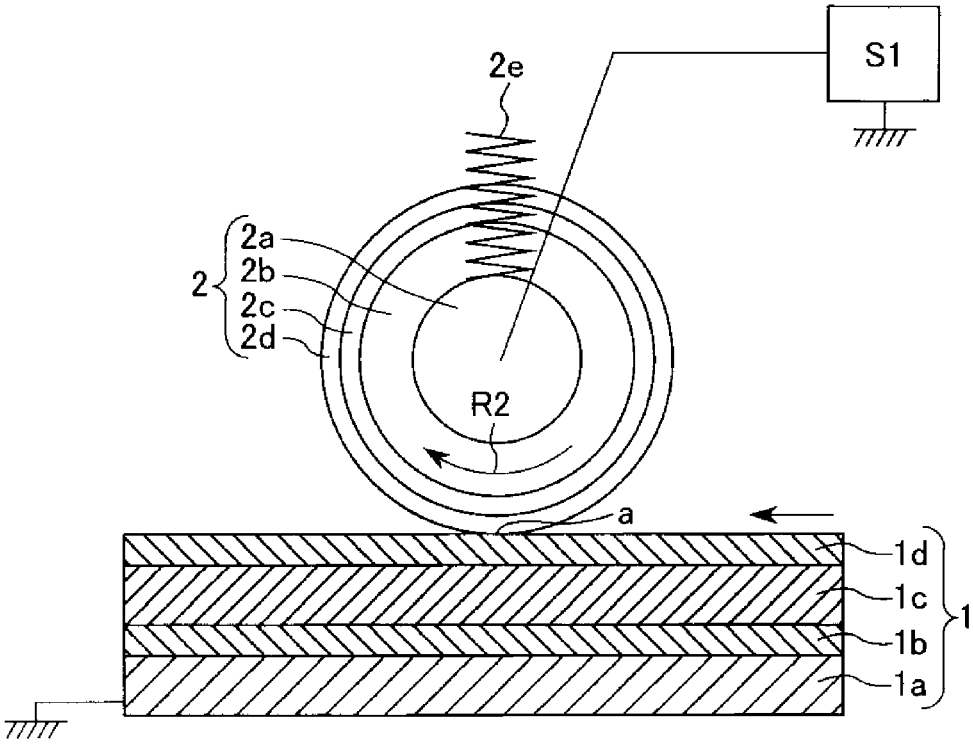
FIG. 2 is a schematic illustration showing layer structures of a photosensitive drum and a charging roller.

The photosensitive drum 1 is a negatively chargeable organic photoconductor (OPC) photosensitive member having an outer diameter of 30 mm in this embodiment, and is rotationally driven by a driving device (not shown) at a process speed (peripheral speed) of 300 mm/sec in the arrow R1 direction (counterclockwise direction). The photosensitive drum 1 is, as shown in FIG. 2, constituted by coating three layers consisting of an undercoat layer 1*b* for improving adhesiveness to an upper layer while suppressing interference of light, a photocharge generating layer 1*c*, and a charge transporting layer 1*d* in this order on the surface of an aluminum-made cylinder (electroconductive photosensitive member substrate) 1*a*.

In FIG. 1, the charging roller 2 is rotatably held by shaft-supporting members (not shown) at both end portions of its core metal 2*a* and is urged toward a center direction of the photosensitive drum 1 by an urging spring 2*e*, thus being urged against the photosensitive drum 1 with a predetermined urging force. Therefore, the charging roller 2 is rotated in a direction indicated by an arrow R2 (clockwise direction) by the rotational drive of the photosensitive drum 1. A press-contact portion between the photosensitive drum 1 and the charging roller 2 is a charge portion (charging nip) a.

To a core metal 2*a* of the charging roller 2, a charging bias voltage is applied from a charging power source S1 under a predetermined condition, so that the peripheral surface of the photosensitive drum 1 is contact-charged to a predetermined polarity and a predetermined potential. In this embodiment, the charging bias voltage applied to the charging roller 2 is an oscillating voltage in the form of a DC voltage (Vdc) biased with an AC voltage (Vac). More specifically, the charging bias voltage is the oscillating voltage in the form of the DC voltage (−500 V) biased with the AC voltage (peak-to-peak voltage: 1.2-2.0 kV, frequency: 2 kHz), and the peripheral surface of the photosensitive drum 1 is contact-charged uniformly to −500 V (dark potential: Vd). Incidentally, the peak-to-peak voltage of the AC voltage is determined by control since the resistance of the charging roller 2 is fluctuated by an environment and durability.

The exposure device 3 is a laser beam scanner using a semiconductor laser in this embodiment. The exposure device 3 outputs laser light (beam) modulated correspondingly to an image signal inputted from a host processing device such as an image reading device (not shown) and subjects the uniformly charged surface of the photosensitive drum 1 to scanning exposure (image exposure) to light L at an exposure position b.

In this embodiment, the image forming apparatus can execute an operation in an image forming mode in which an image depending on image information from the exposure device 3 is formed and an operation in a band image mode in which a band image which is a toner image in a certain amount and a certain area is formed on the photosensitive drum 1 in a switching manner.

In the operation in the normal image forming mode, i.e., during normal image formation for forming the image depending on image information from the exposure device 3, by the scanning exposure to light L, the potential of the surface of the photosensitive drum 1 at a portion which has been irradiated with the laser light L is lowered, so that an electrostatic image is successively formed on the photosensitive drum 1 surface correspondingly to image information provided by the scanning exposure to light L. The band image mode will be described in detail later.

The developing device 4 is a reverse-developing device of a two-component magnetic brush developing type in this embodiment, and the toner is deposited on an exposed portion (light portion) of the photosensitive drum 1 surface to reversely develop the electrostatic latent image. The developing device 4 includes a developing container 4*a*, a rotatable non-magnetic developing sleeve 4*b* which is provided at an opening of the developing container 4*a*, and a fixed magnet roller 4*c* contained in the developing sleeve 4*b*. A developer (toner) 4*e* in the developing container 4*a* is coated in a thin layer on the developing sleeve 4*b* and is conveyed to a developing portion c where the developing sleeve 4*b* opposes the photosensitive drum 1. The developer 4*e* in the developing container 4*a* is a mixture of the toner and a magnetic carrier and is conveyed toward the developing sleeve 4*b* while being stirred uniformly by rotation of two developer-stirring members 4*f*. In this embodiment, the magnetic carrier has a resistivity of about $10^{13}$ ohm.cm and a particle size of 40 μm, and the toner is triboelectrically charged to a negative polarity by friction with the magnetic carrier. The toner content (concentration) in the developing container 4*a* is detected by a concentration sensor (not shown), and on the basis of this detected information, the toner is supplied in an appropriate amount from a toner hopper 4*g* to the developing container 4*a*, so that the toner content is adjusted at a constant level.

The developing sleeve 4*b* is provided closely and oppositely to the photosensitive drum 1 while keeping the closest distance with respect to the photosensitive drum 1 at 300 μm at the developing portion c, thus forming a developing nip. The developing sleeve 4*b* is rotationally driven in a direction indicated by an arrow R4 opposite from the rotational direction (counterclockwise direction) of the photosensitive drum 1 at the developing portion c. To the developing sleeve 4*b*, a predetermined developing bias is applied from a developing power source S2. In this embodiment, the developing bias voltage applied to the developing sleeve 4*b* is the oscillating voltage in the form of a DC voltage (Vdc) biased with an AC voltage (Vac). More specifically, the developing bias voltage is the oscillating voltage in the form of the DC voltage (−350 V) biased with the AC voltage (peak-to-peak voltage: 8 kV, frequency: 2 kHz).

The transfer roller 5 press-contacts the photosensitive drum 1 with a predetermined urging force to form the transfer portion d and to which a transfer bias (transfer bias of a positive polarity opposite from the negative polarity as a normal charge polarity of the toner; +500 V in this embodiment) is applied from a power source S3. As a result, at the transfer portion d, the toner image on the photosensitive drum 1 surface is transferred onto the transfer material P such as a sheet (paper) as a second image bearing member.

The fixing device 6 includes a rotatable fixing roller 6*a* and a rotatable pressing roller 6*b*, and heat-presses the toner image transferred on the surface of the transfer material P while nip-conveying the transfer material P at a fixing nip between the fixing roller 6*a* and the pressing roller 6*b*, thus heat-fixing the toner image.

The cleaning device 7 rubs the surface of the photosensitive drum 1, after the toner image transfer onto the transfer material P, with the cleaning blade 7*a*. As a result, the surface of the photosensitive drum 1 is cleaned by removal of a transfer residual toner, thus being subjected to image formation repeatedly.

A pre-exposure means 8 removes residual electric charges remaining on the photosensitive drum surface after the transfer by light irradiation, so that the surface potential of the photosensitive drum 1 before the charging is made constant at about zero.

(Charging Device)

Next, the charging device 2 used in this embodiment will be described.

As the charging device (primary charger) 2, a rubber roller contacted to and rotated by the photosensitive drum 1 (hereinafter, referred to as the "charging between") is used.

The charging roller 2 has a length of 320 mm with respect to its longitudinal direction. As shown in FIG. 2, the charging roller 2 has, around the core metal (supporting member) 2*a*, three-layer structure consisting of a lower layer 2*b*, an intermediary layer 2*c*, and a surface layer 2*d* which are successively laminated in this order. The lower layer 2*b* is a foam sponge layer for decreasing charging noise, and the surface layer 2*d* is a protective layer provided for preventing an occurrence of leakage even when a defect such as a pin hole is present on the photosensitive drum 1.

More specifically, the charging roller 2 in this embodiment has the following specification.

Core metal 2*a*: stainless steel rod with a diameter of 6 mm

Lower layer 2*b*: carbon-dispersed foam EPDM (specific gravity: 0.5 g/cm$^3$, volume resistivity: $10^2$-$10^9$ ohm.cm, layer thickness: 3.0 mm)

Intermediary layer 2*c*: carbon-dispersed NBR rubber (volume resistivity: $10^2$-$10^5$ ohm.cm, layer thickness: 700 μm)

Surface layer 2*d*: "Toresin" resin, as a fluorine-containing compound, in which tin oxide and carbon particles are disposed (volume resistivity: $10^7$-$10^{10}$ ohm.cm, surface roughness (JIS ten-point average surface roughness Ra): 1.5 μm, layer thickness: 10 μm)

Figure 3:
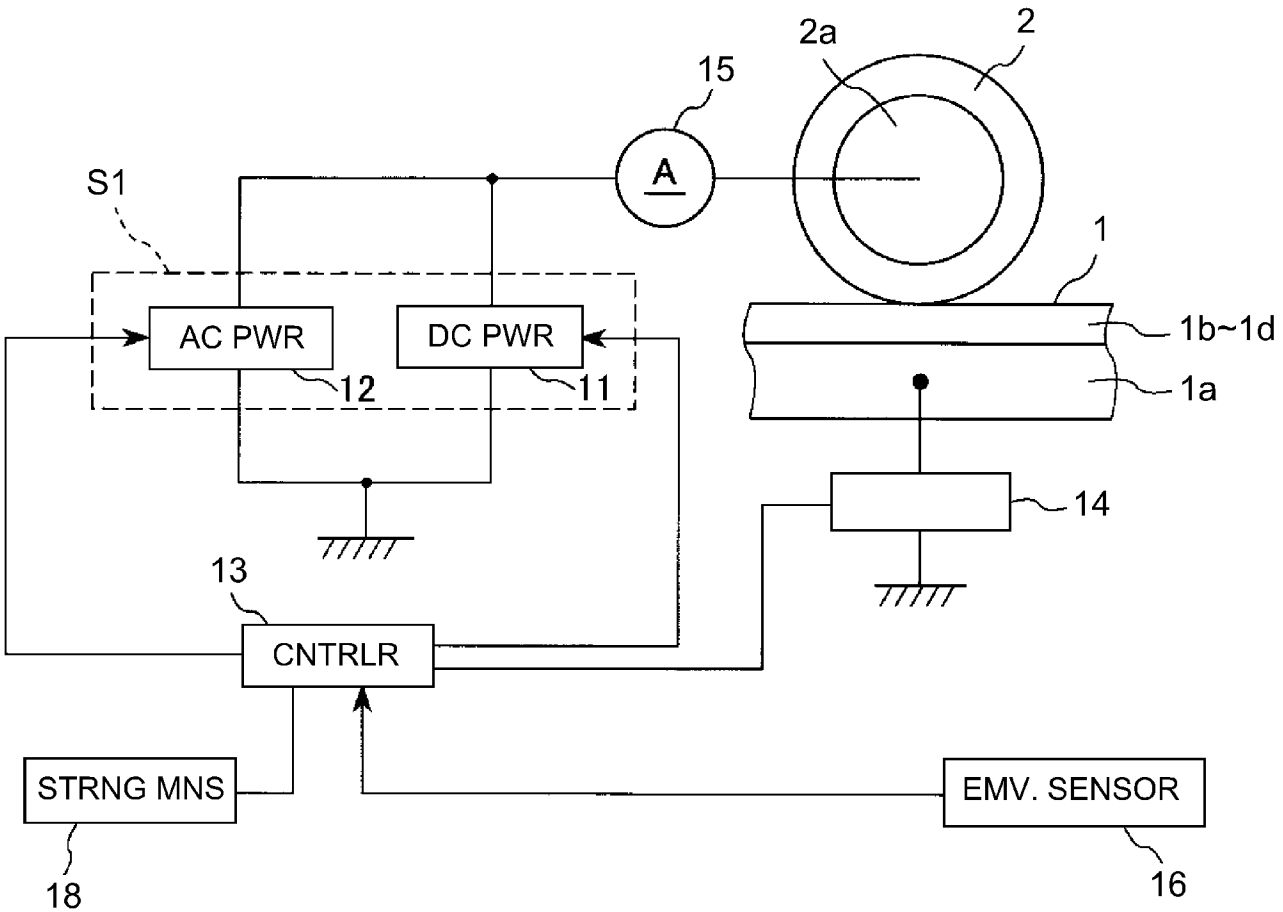
FIG. 3 is a block circuit diagram of a charging bias applying system.

FIG. 3 is a block circuit diagram of a charging bias applying system for the charging roller 2.

The peripheral surface of the rotating photosensitive drum 1 is electrically charged to a predetermined potential by applying a predetermined oscillating voltage (bias voltage: Vdc+Vac) in the form of a DC voltage biased with an AC voltage having a predetermined frequency from the power source S1 to the charging roller 2 through the core metal 2*a*.

The power source S1 as a voltage applying means for the charging roller 2 includes a DC power source 11 and an AC power source 12.

A control circuit 13 has the function of controlling the power source S1 so that the charging roller 2 is supplied with either one of the DC voltage and the AC voltage or supplied with the oscillating (superposed) voltage in the form of the DC voltage biased with the AC voltage by effecting ON/OFF control of the DC power source 11 and the AC power source 12. The control circuit 13 further has the function of controlling a value of the DC voltage to be applied from the DC power source 11 to the charging roller 12 and a value of peak-to-peak voltage or AC current of the AC voltage to be applied from the AC power source 12 to the charging roller 2.

A measuring circuit 14 is an AC current value (or peak-to-peak voltage value) measuring circuit 14 as a first detecting means for measuring the value of the AC current passing through the charging roller 2 via the photosensitive drum 1. From this circuit 14 to the above-described control circuit 13, information on the measured AC current value (or peak-to-peak voltage value) is inputted.

An environment sensor 16 (thermometer and hygrometer) 16 is a means for detecting an ambient environment in which the printer is mounted. From this environment sensor 16 to the above-described control circuit 13, detected environment information is inputted.

Further, the control circuit 13 has the function of executing a computing and determining program of an appropriate peak-to-peak voltage value of the applied AC voltage to the charging roller 2 in the charging step of a printing process, on the basis of the AC current information (or peak-to-peak voltage value information) inputted from the AC current value (or peak-to-peak voltage value) measuring circuit 14 and the environment information inputted from the environment sensor 16.

(Discharge Current Amount Control)

Next, a known control method of the peak-to-peak voltage of the AC voltage to be applied to the charging roller 2 during the normal image formation by the contact in the normal image forming mode will be briefly described below.

Figure 4:
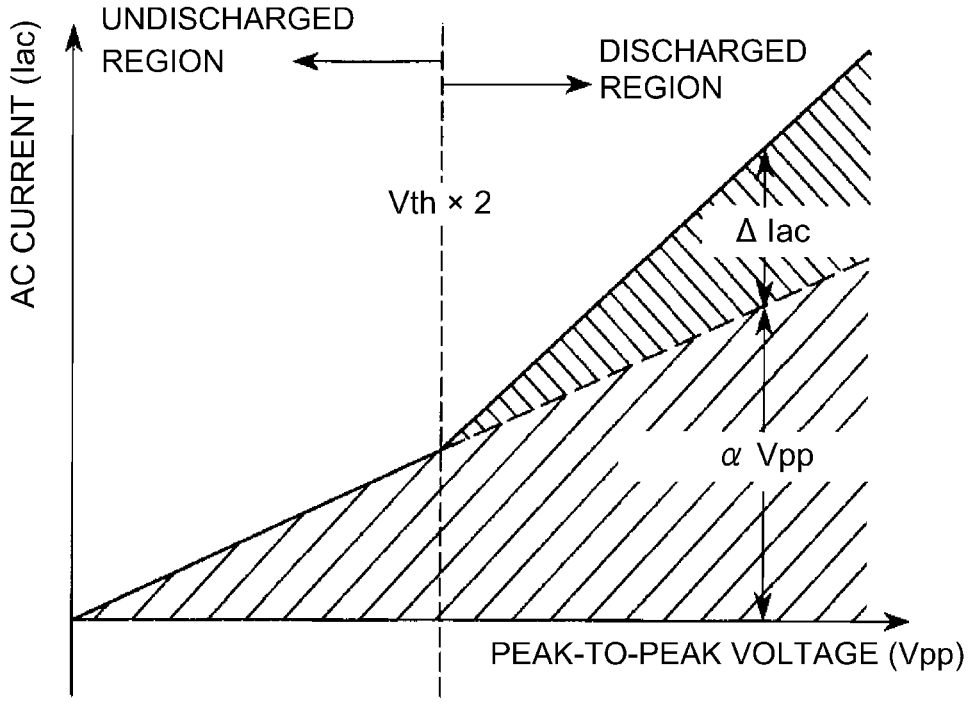
FIG. 4 is a schematic measurement illustration of a discharge current amount.

As shown in FIG. 4, an AC current Iac has a linear relation to a peak-to-peak voltage Vpp of the charging AC voltage in a region less than a charge start voltage Vth×2 (V) (undischarged region) and is then linearly increased gradually in a discharged region from the charge start voltage Vth×2 (V) with an increasing peak-to-peak voltage value. In a similar experiment in a vacuum in which no electric discharge occurs, the linearity of Iac is kept, so that the resultant increment of Iac is regarded as a discharge current increment ΔIac.

Therefore, when a ratio of the AC current Iac to the peak-to-peak voltage Vpp less than the charge start voltage Vth×2 (V) is taken as α, an AC current, other than the current due to discharge, such as a nip current is represented by α.Vpp. A difference ΔIac between the current value Iac measured during the application of a voltage equal to or more than the charge start voltage Vth×2 (V) and the above value α.Vpp calculated according to the following formula 1 is defined as discharge current amount as a substitution for a discharge amount.

$$\Delta Iac = Iac - \alpha . Vpp \quad \text{(formula 1)}$$

The discharge current amount is changed depending on a change in environmental condition and an increase in amount of usage of the image forming apparatus in the case of performing the charging under control with a constant voltage or with a constant current. This is because a relationship between the peak-to-peak voltage and the discharge current amount and a relationship between the AC current value and the discharge current amount are changed.

In an AC constant current control method, the charging of the member to be charged is controlled by a total amount of current flowing from the charging member to the member to be charged. The total current amount is, as described above, the sum of the current (nip current α.Vpp) flowing into the contact portion and the current (discharge current amount ΔIac) which is carried by the discharge at the non-contact portion. In the constant current control method, the charge control is effected by current including not only the discharge current which is current necessary to actually charge electrically the member to be charged but also the nip current.

For that reason, the discharge current amount ΔIac cannot be actually controlled. In the constant current control method, even in the case of effecting control at the same current value, depending on an environmental change of a material for the charging member, the discharge current amount is decreased when the nip current is increased and is increased when the nip current is decreased. For this reason, it is impossible to completely suppress a change (increase/decrease) in discharge current amount even by the AC constant current control method. When the lifetime of the image forming apparatus is intended to be prolonged, it is difficult to compatibly realize abrasion resistance of the photosensitive drum 1 and the charging uniformity.

Therefore, in order to always obtain a desired discharge current amount, the control was effected in the following manner.

When the desired discharge current amount is taken as D, a method of determining the peak-to-peak voltage providing the discharge current amount D will be described.

In this embodiment, during the preparatory rotation operation for printing, the computing and determining program for the appropriate peak-to-peak voltage value of the AC voltage to be applied to the charging roller 2 in the charging step during the image forming process is executed by the control circuit 13 as a control means.

Figure 5:
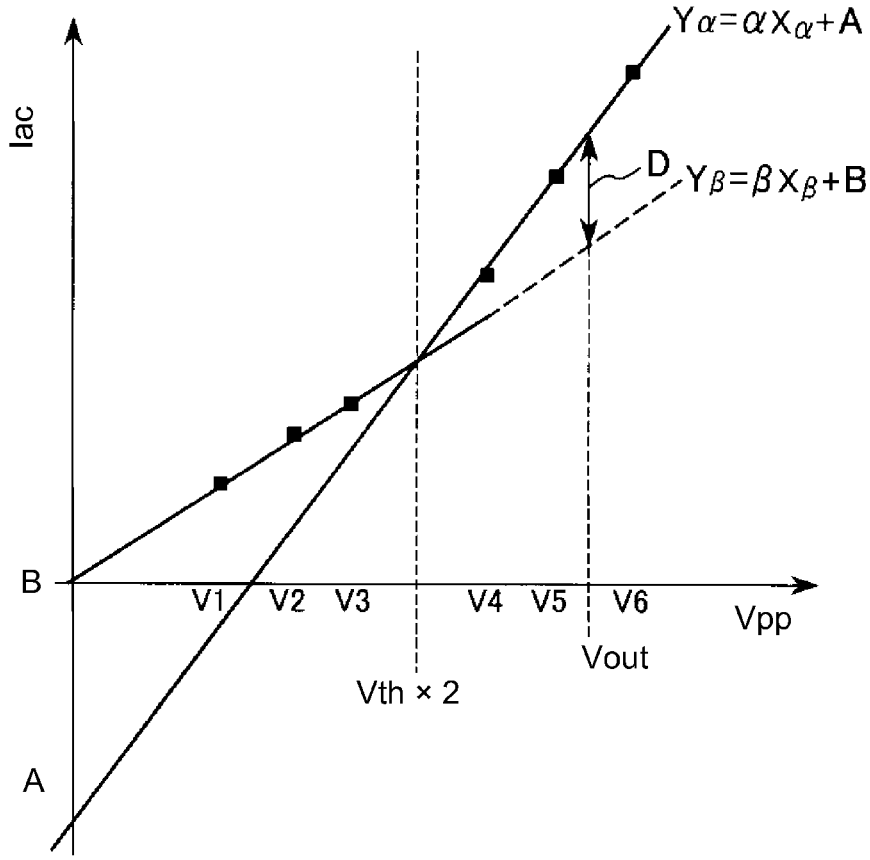
FIG. 5 is a graph showing a relationship between a peak-to-peak voltage and an AC current of an AC bias.

The description will be made with reference to Vpp−Iac graph of FIG. 5 and a control flow chart of FIG. 6.

The charging bias control is started, so that the discharge current control is effected (S101-S109). The control circuit 13 controls the AC power source 12 so that three values (V1, V2 and V3) of peak-to-peak voltages (Vpp) of the AC voltages in the discharged region and three values (V4, V5 and V6) of peak-to-peak voltages (Vpp) of the AC voltages in the undischarged region are successively applied to the charging roller 2 as shown in FIG. 5.

Figure 6:
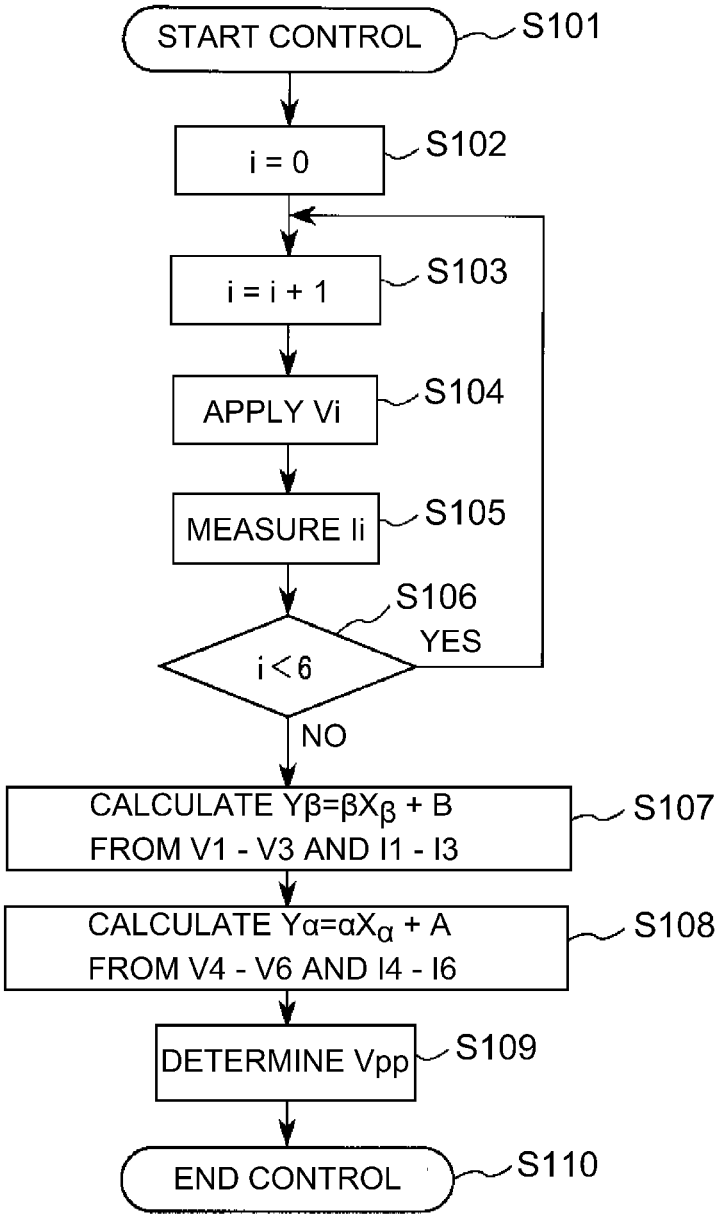
FIG. 6 is a flow chart of charging bias control for determining the peak-to-peak voltage by discharge current control during an operation in a photosensitive member defect recovery mode.

That is, in FIG. 6, when the discharge current control is started (S101), the control means (control circuit) 13 increments a counter set at zero (i=0) by 1 (i=i+1=1) (S102, S103), to that a first voltage control step is started. That is, the control circuit 13 controls the AC power source 12 to generate the peak-to-peak voltage V1 in the undischarged region. Then, a value I1 of the AC current flowing into the charging roller 2 via the photosensitive drum 1 at that time is measured by the AC current value measuring circuit 14. The voltage V1 and the AC current value I1 are stored in a storing means 18 of the control circuit 13. These steps are S102-S106.

In S106, when i does not reach 6, the operation is returned to S103. The control circuit 13 increments the counter by 1 (i=2) and controls the AC power source 12 to generate the peak-to-peak voltage V2 in the undischarged region. Then, a value I2 of the AC current flowing into the charging roller 2 via the photosensitive drum 1 at that time is measured by the AC current value measuring circuit 14. The voltage V2 and the current value I2 are stored in the storing means 18 of the control circuit 13 (S103-S106).

As described above, the control circuit 13 executes a repeating step until i reaches 6, i.e., in which the three values (I1-I3 for V1-V3) in the undischarged region and the three values (I4-I6 for V4-V6) in the discharged region which are six values in total are measured.

Next, from the three voltage values V1-V3 and three current values I1-I3 in the undeveloped region and the three voltage values V4-V6 and three current values I4-I6, the following formulas 2 and 3 are obtained (S107, S108). That is, in S107 and S108, from the above six measured values (of each of the voltage and AC current), collinear approximation of a relationship between the peak-to-peak voltage and the AC current in the discharged area and the undischarged area, respectively, is performed by using lease square method to obtain the following formulas 2 and 3 (FIG. 5).

(Approximated Line in Discharged Area)

$$Y_\alpha=\alpha X_\alpha+A \quad \text{(formula 2)}$$

(Approximated Line in Undischarged Area)

$$Y_\beta=\beta X_\beta+B \quad \text{(formula 3)}$$

Thereafter, in S109, the peak-to-peak voltage Vpp corresponding to the target discharge current amount D is determined by formula 4 below as a difference between the approximated line in the discharged area (formula 2) and the approximated line in the undischarged area (formula 3).

$$Vpp=(D-A+B)/(\alpha-\beta) \quad \text{(formula 4)}$$

Then, the peak-to-peak voltage of the AC voltage applied to the charging roller 2 is switched to the Vpp obtained by the above formula 4. Thereafter, the constant voltage control is effected and then the contact goes to the printing step in the above-described normal image forming mode (S110).

Thus, the peak-to-peak voltage Vpp necessary to obtain the predetermined target discharge current amount D during the printing every time of the preparatory rotation operation for printing is calculated, and during the printing, the obtained peak-to-peak voltage Vpp is applied to the charging roller 2 by the constant current control, so that it was possible to absorb manufacturing variation of the charging roller 2, fluctuation in electric resistance value due to an environmental change in material for the charging roller 2, and variation in high-voltage device of the apparatus main assembly, so that it became possible to obtain a desired discharge current amount with reliability.

In this embodiment, in one discharge current control, sampling of the six values in total consisting of the three values (V1, V2 and V3) which are not more than Vth×2 and the three values (V4, V5 and V6) which are not less than Vth×2. The six sampling values were V1=500 Vpp, V2=700 Vpp, V3=900 Vpp, V4=1500 Vpp, V5=1700 Vpp and V6=1900 Vpp.

(Photosensitive Member Defect Recovery Mode)

Next, the photosensitive member defect recovery mode which is a characteristic feature of the present invention will be described.

Figure 7:
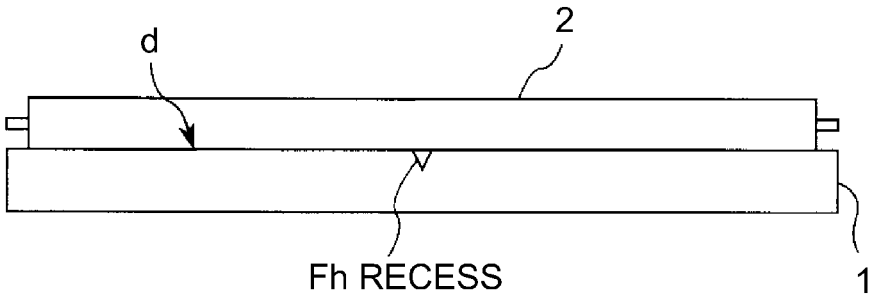
FIG. 7 is a schematic view showing a state of a charging nip in the case where a photosensitive member defect is generated.
Figure 8:
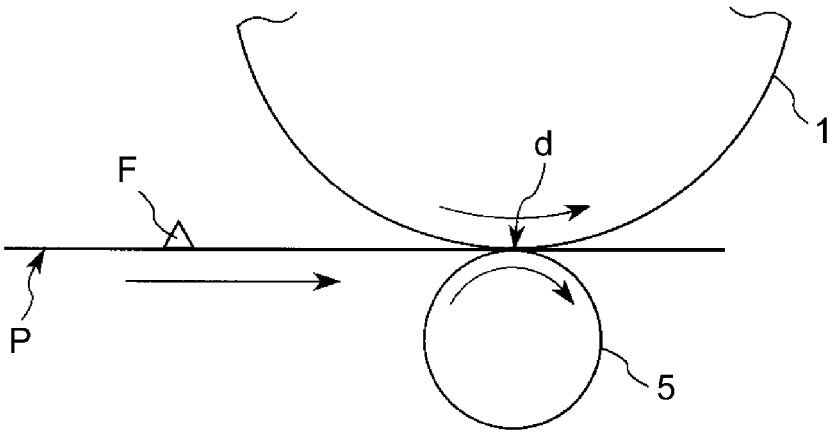
FIG. 8 is an illustration of a generation process of the photosensitive member defect.

The problem to be solved by the present invention is to alleviate the image defect, as shown in FIGS. 7 and 8 as examples, generated in the case where when a foreign matter F such as metal powder is incorporated onto the transfer material P, the foreign matter F enters the nip d between the primary transfer roller 5 and the photosensitive drum 1 to generate a damage hole (recess) Fh in the photosensitive drum 1. Hereinbelow, the action of the present invention will be described.

FIG. 7 schematically shows a state of the charging nip d in the case where the damage hole Fh is generated on the photosensitive drum.

At a portion where the damage hole Fh is generated, a minute gap with the charging roller 2 is formed and therefore a discharge state depending on a distance at the opposing portion is different from those at other portions. For that reason, the discharge amount is insufficient and thus the charge potential becomes low and therefore the developer is more deposited to generate the black spots. Further, depending on a shape of the damage, the electric discharge can become excessive. In that case, the charge potential becomes higher than that at a peripheral portion, so that white spots are generated on the image. The present invention is characterized by providing the "photosensitive member defect recovery mode" for recovering the image when such (white) spot images are generated.

In the photosensitive member defect recovery mode in the present invention, first, an operation in the band image mode is executed during non-image formation, not during image formation in which the operation in the image forming mode is performed, so that a band-like toner image (band image) is formed on the photosensitive drum. Then, for a predetermined time after the band image formation, e.g., for about 30 sec, the rotation of the photosensitive drum is continued.

That is, as a method of photosensitive member defect recovery, first, a solid band image with a certain width (certain amount and certain area) is formed by development on the photosensitive drum by the operation in the band image mode. That is, the photosensitive drum is uniformly charged by the charging means and thereafter is exposed to light with a predetermined width with respect to the circumferential direction of the photosensitive drum, followed by the development to form the solid band image on the photosensitive drum. The width of the solid band image with respect to the photosensitive drum circumferential direction is at least one full circumference of the photosensitive drum (i.e., corresponding to a length of one full turn of the photosensitive member). Further, the width of the band image with respect to a longitudinal direction of the photosensitive drum is a predetermined width wider than an image forming region (image forming width) during the operation in the image forming mode (i.e., during the normal image formation), i.e., the whole region of the developing nip (region in which the development by the developing sleeve is possible).

Here, the "certain amount and certain area" of the solid band image may be the toner amount necessary to fill the recess formed in the photosensitive member with the toner. This amount is different depending on the diameter or the width of the photosensitive drum. That is, the toner may only be supplied in the amount such that the band image is formed to create a toner stagnation portion between the cleaning blade and the photosensitive drum so as to fill the recess over the full circumference of the drum, and the toner amount is not limited to that for an intended image. That is, the amount and area may appropriately be selected as those suitable for the system in order to achieve a predetermined object. For that reason, the length of the band image may also be shorter than the drum full circumference, and the width of the band image may also be narrower than the exposure width. However, the cleaning condition is different depending on the states of the drum and the blade and therefore it is preferable that the band image is formed in the length, corresponding to at least the one full circumference of the drum, and with the width in which the exposure is possible.

Therefore, e.g., the certain amount and certain area can be an area of 220 mm in photosensitive drum longitudinal length and 94.2 mm in one full circumference of the photosensitive drum, i.e., the area of about 20724 $mm^2$. Incidentally, the certain amount and certain area can be changed depending on the effect as described above. Even when the certain amount and certain area is less than the photosensitive drum one full circumference, the developer stagnated at the cleaning blade portion can be rubbed in the photosensitive member defect portion by idling (blank rotation) after the band image formation.

During the operation in the band image mode, the developer is supplied to the cleaning device and therefore a transfer high voltage applied to the transfer roller 5 is in the OFF state.

The toner which reaches the cleaning blade nip e is scraped and removed at the cleaning blade nip e but in the case where the defect Fh is present on the photosensitive drum, to the contrary, the developer is rubbed in the defect Fh and thus passes through the blade portion e.

When the developer is rubbed in the photosensitive member defect Fh, the uneven defect portion on the photosensitive drum 1 is filled with the developer, so that a degree of charging non-uniformity is reduced. Particularly, in the case where the defect of the photosensitive drum 1 reaches the base layer, even when the charging high voltage is applied, the applied portion causes leakage and no potential is provided at the applied portion but the applied portion is filled with the developer (toner), so that the insulating property is recovered and thus the spot image becomes inconspicuous.

Incidentally, the photosensitive drum defect on which the toner is deposited has no sensitivity to the exposure and therefore it would be considered that the latent image formation cannot be effected but there is no problem at a minute defect level, so that the photosensitive drum becomes usable at a substantially inconspicuous level in practical use.

However, only by the passing of the toner through the cleaning blade 7*a* simply, the toner is scraped off again to generate the spot image.

Therefore, as a result of study by the present inventor, it was found that it is possible to permanently prevent the spot image from occurring by continuing the rotation, in order to continuously apply the high voltage for a predetermined time, at the charging portion a after the toner passes through the cleaning blade 7*a*. Further, it was found that the image defect (i.e., the photosensitive member defect) is recovered early with a larger set value of the high voltage, thereby to prevent recurrence for a long term. This may be attributable to liability of deposition of the toner at a portion where the recess Fh of the photosensitive drum 1 is softened and melted by heat due to the electric discharge.

In this embodiment, the operation in the photosensitive member defect recovery mode is executed by pressing a photosensitive member cleaning mode i.e., photosensitive member defect recovery mode) switch on an operating panel when the black spot image due to the photosensitive member defect occurs.

Figure 9:
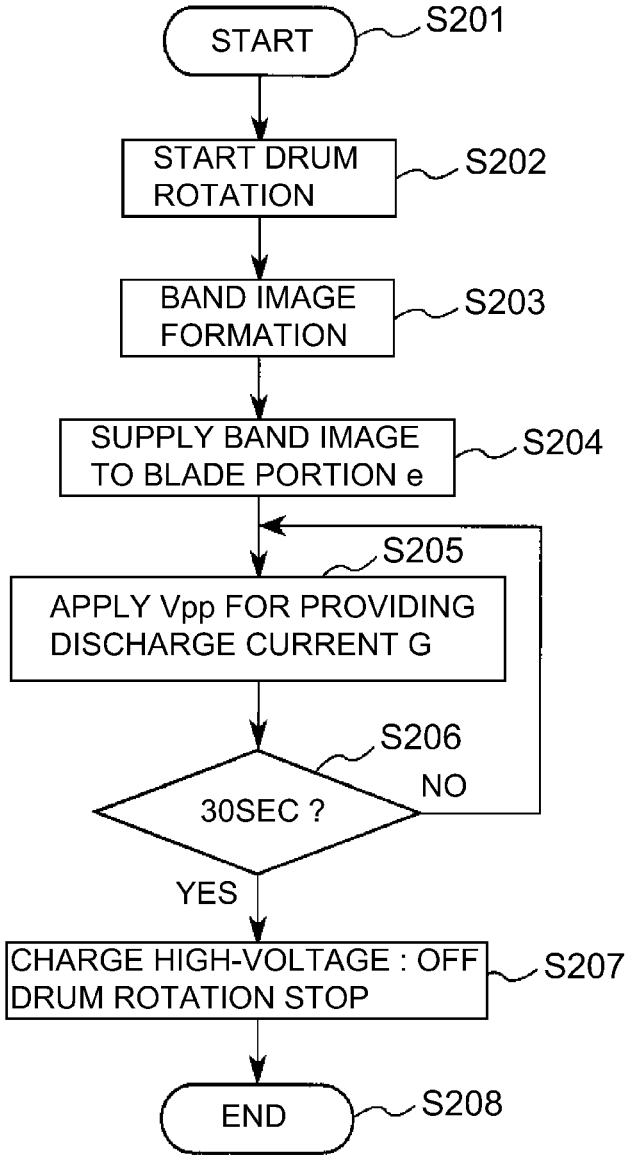
FIG. 9 is a flow chart of photosensitive member defect recovery mode control.

The description will be made based on FIG. 9. The photosensitive member cleaning switch at the operating portion is turned on the start the operation in the image defect recovery mode (S201). The photosensitive drum 1 starts rotation (S202), and the control circuit 13 first executes the operation in the band image mode (S203). In S203, in this embodiment, the band image of 300 mm with respect to the longitudinal direction of the photosensitive drum 1 and of 200 mm with respect to the rotational direction of the photosensitive drum 1 is formed in the same charging and developing high voltage settings as those during the image formation in the normal image forming mode. Then, the primary transfer high voltage (transfer bias) is adjusted so that the band image on the photosensitive drum 1 is not transferred onto the transfer material P side. In this embodiment, the transfer bias is turned off.

Therefore, after the band image formation, the band image formed on the photosensitive drum is supplied to the blade portion e without being transferred onto the transfer material P side (S204). As a result, the developer (toner) is rubbed in the defect portion Fh of the photosensitive drum and then passes through the blade portion e to move to the charging portion a. At this time, in S204, the developing high voltage (application) and the sleeve drive are stopped, and in a state in which only the charging high voltage (charging bias in the form of the DC voltage biased with the AC voltage) is applied at the charging portion a, the photosensitive drum is rotated for 30 sec in this embodiment (S205, S206). Then, after the lapse of 30 sec, the charging high voltage (application) is turned off and the rotation of the photosensitive drum is stopped (S207) to end the operation (S208).

An amplitude of the AC voltage, i.e., the peak-to-peak voltage (Vpp), applied to the charging portion for 30 sec is made larger than the AC voltage peak-to-peak voltage during the image formation in the normal image forming mode so as to provide the discharge current G. A specific determining method is as follows.

Table 1 shown below is a table showing the above-described discharge current (first discharge current) D and the discharge current (second discharge current) G in the operation in the photosensitive member defect recovery mode with respect to an absolute water content ("A.W.C.") detected by the environment sensor 16. Between the respective values of the water content, a target discharge current is calculated by linear interpolation. Here, G is set at a value larger than that of D, but in the case where G is excessively large, it is unpreferable that the damage of the photosensitive member by the electric discharge becomes excessive to cause the image flow, the cleaning blade noise and shuddering. Therefore, there was a need to determining an allowable level in advance depending on the environment to control the discharge current within a certain level.

In this embodiment, G is set at a value which is uniformly higher than D by 20%. Further, a constitution in which during the above-described discharge current control, a charging peak-to-peak voltage (first AC voltage peak-to-peak voltage) VD, at the time of the image formation, corresponding to D and a peak-to-peak voltage (second AC voltage peak-to-peak voltage) VG corresponding to G used in the operation in the photosensitive member defect recovery mode were calculated and the peak-to-peak voltage was switched to VG when the operation in the photosensitive member defect recovery mode was executed was employed.

Table 2 shown below shows a time, every charging peak-to-peak voltage, from after the above-described band image is formed until the black spot on the image disappears by continuing the rotation in the case where the defect of 50 μm is generated on the photosensitive member. However, in Table 2, the discharge current ("CURRENT") (μA) during the application of the AC voltage peak-to-peak voltage (second AC voltage peak-to-peak voltage) is shown, and the black spot disappearing time is represented by a recovery time ("TIME") (sec). This experiment is conducted under the environment of the absolute water content of 10.5 g. It is understood that the black spot disappearing time is shorter with a larger peak-to-peak voltage. Further, recurrence of the black spot in subsequent sheet passing at the peak-to-peak voltage not more than a certain peak-to-peak voltage is also shown.

TABLE 1

| S.W.C. | D (μA) | G (μA) |
|---|---|---|
| 1.0 g | 80 | 96 |
| 2.9 g | 75 | 90 |
| 5.8 g | 70 | 84 |
| 10.5 g | 65 | 78 |
| 15.0 g | 60 | 72 |
| 21.6 g | 55 | 66 |
| 24.0 g | 50 | 60 |

TABLE 2

| CURRENT (μA) | TIME (sec) |
|---|---|
| 40 | 250 |
| 50 | 160 |
| 60 | 90 |
| 70 | 30 |
| 80 | 20 |
| 90 | 15 |
| 100 | 10 |

Incidentally, this portion's current control is effected in an adjusting period during the main switch actuation and in first post-rotation after the image formation on 500 sheets and is constituted so that it can follow changes in charging peak-to-peak voltage and discharge current characteristic which change with the charge in environment of the main assembly and with a resistance fluctuation by energization to the charging roller.

By the above-described constitution, even in the case where the defect is actually generated on the photosensitive member by forcedly incorporating iron powder of about 50 μm into the primary transfer portion after the sheet passing of 50 K ($50\times10^3$) sheets, it was possible to maintain a good image without particularly generating the black spot image until the photosensitive member reaches its end (500 K) of lifetime.

Embodiment 2

In another embodiment (this embodiment) of the present invention, a constitution in which the operation in the photosensitive member defect recovery mode described in Embodiment 1 is executed when a front door of the image forming apparatus is opened and closed and when the main switch of the main assembly is actuated was employed. As a result, the operation is always executed with timing when the front door is opened and closed and part exchange or maintenance is performed and thus the photosensitive member defect can generate, and therefore, it was possible to prevent the generation of the image defect without executing the operation in the photosensitive member defect recovery mode by a user when the photosensitive member defect was generated.

Further, in this embodiment, a constitution in which a charging DC (voltage) value of the applied charging bias during the operation in the photosensitive member defect recovery mode was made different depending on an ambient temperature detected by an external temperature detecting sensor was employed. This is because in the case where the ambient temperature is high, the electric discharge heat to be generated may be small but in the case where the ambient temperature is low, there is a need to increase the electric discharge heat to be generated.

Table 3 shown below shows a difference of the value of DC (voltage) applied during the operation in the photosensitive member defect recovery mode with respect to the charging DC value during the image formation in the image forming mode. The control circuit 13 changes, on the basis of a temperature detection result during the execution of the operation in the photosensitive member defect recovery mode, the DC value by adding the difference in Table 3 to the charging DC setting value during the image formation at the time of executing the operation in the photosensitive member defect recovery mode, and the charging bias in the form of the DC voltage biased with the AC voltage described in Embodiment 1 is applied.

TABLE 3

| TEMP. (° C.) | ΔDC (V) |
|---|---|
| 5 | 200 |
| 10 | 170 |
| 15 | 140 |
| 20 | 110 |
| 25 | 80 |
| 30 | 50 |
| 35 | 20 |
| 40 | 0 |
| 45 | 0 |

By the above-described constitution, even in the case where the defect is actually generated on the photosensitive member by forcedly incorporating iron powder of about 50 μm into the primary transfer portion after the sheet passing of each of 10 K ($50\times10^3$) sheets, 100 K sheets and 250 K sheets, it was possible to maintain a good image without particularly generating the black spot image until the photosensitive member reaches its end (500 K) of lifetime.

As apparent from the above description, the image forming apparatus of the present invention can maintain a good image until the photosensitive member reaches its end of lifetime even in the case where the uneven defect is generated the photosensitive member.

In the above-described embodiments, the constitution in which the roller charging for applying the AC voltage and the DC voltage in a superposition manner was employed and the AC voltage peak-to-peak voltage during the operation in the photosensitive member defect recovery mode was determined by the discharge current control was employed.

Incidentally, the charging high voltage used in the operation in the member defect recovery mode may also be the DC voltage higher than the DC voltage value during the image formation including another charging method. Further, a similar effect can be obtained also by a method in which the peak-to-peak voltage is not determined by the control but a certain value is added to the high voltage value at the time of the image formation.

Further, it is clear that the width and length of the band image and the rotation time in the operation in the photosensitive member defect recovery mode are settable at any values. Further, it is clear that the band image is not required to be the black toner image but can be the toner image of another color in a multi-color image forming apparatus or the like.

In the above-described embodiment, the present invention is described with respect to the image forming apparatus of the type in which the toner image is directly transferred from the photosensitive drum onto the transfer paper or the like as the transfer material P but is not limited thereto.

The present invention is also applicable to an image forming apparatus of an intermediary transfer type in which the toner image on the photosensitive drum is once transferred onto an intermediary transfer member as the transfer material P and thereafter the toner image on the intermediary transfer member is transferred onto the recording material such as the transfer paper. The image forming apparatus with such a constitution is also well-known by the person originally skilled in the art and will be omitted from further detailed description.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 053195/2011 filed Mar. 10, 2011, which is hereby incorporated by reference.

What is claimed is:

1. An image forming apparatus comprising:

a rotatable photosensitive member;

a charging device for electrically charging said photosensitive member by being supplied with a superimposed charging bias of a DC voltage and an AC voltage;

an exposure device for exposing to light the photosensitive member, charged by said charging device, to form an electrostatic image;

a developing device for developing the electrostatic image with a toner;

a transfer device for transferring a toner image from said photosensitive member onto a recording material by being supplied with a transfer bias;

a cleaning blade for removing the toner remaining on said photosensitive member;

a selecting device for selecting a mode, in which an operation is executed, from modes including at least an image forming mode in which an image corresponding to inputted image information is formed on the recording material and a recovery mode different from the image forming mode; and a controller for effecting, when execution of the operation in the recovery mode is selected by said selecting means, control so that a band-like toner image is formed on said photosensitive member in a certain amount and in a certain area and then is supplied to said cleaning blade by changing the transfer bias applied to said transfer device and so that a peak-to-peak voltage of the AC voltage larger than that of the AC voltage applied to said charging device in the operation in the image forming mode is applied to said charging device in a predetermined period after a leading end of the band-like toner image subjected to removal by said cleaning blade passes through said charging device.

2. An image forming apparatus according to claim 1, wherein the predetermined period is at least a time when said photosensitive member rotates one full circumference.

3. An image forming apparatus according to claim 1, wherein when the execution of the operation in the recovery mode is selected, said controller forms the band-like toner image by uniformly charging said photosensitive member by said charging device and by exposing to light the charged photosensitive member by said exposure device with a predetermined width corresponding to at least one full circumference of said member with respect to a circumferential direction of said member and with a predetermined width wider than an image formation width during image formation with respect to a longitudinal direction of said photosensitive member to form an electrostatic image, and then by developing the electrostatic image by said developing device.

4. An image forming apparatus according to claim 1, wherein said controller executes a determination procedure for determining the peak-to-peak voltage of the AC voltage applied to said charging device in the operation in the image forming mode and controls the AC voltage applied to said charging device in the operation in the recovery mode so as to be larger than the peak-to-peak voltage of the AC voltage determined by the determination procedure by a predetermined value.

5. An image forming apparatus according to claim 1, wherein said controller controls a current passed between said charging device and said photosensitive member by electric discharge in the operation in the image forming mode so as to have a first current amount and controls the current passed between said charging device and said photosensitive member by electric discharge in the operation in the recovery mode so as to have a second current amount larger than the first current amount.

6. An image forming apparatus according to claim 5, further comprising a detecting device for detecting an environment, wherein said controller determines the first current amount and the second current amount on the basis of a detection result of said detecting device.

7. An image forming apparatus according to claim 1, further comprising a detecting device for detecting an environment, wherein said controller changes, on the basis of a detection result of said detecting device, a difference between the DC voltage applied to said charging device in the operation in the image forming mode and the DC voltage applied to said charging device in the operation in the recovery mode.

* * * * *